US008744862B2

(12) United States Patent
You

(10) Patent No.: US 8,744,862 B2
(45) Date of Patent: Jun. 3, 2014

(54) WINDOW SELECTION BASED ON TRANSIENT DETECTION AND LOCATION TO PROVIDE VARIABLE TIME RESOLUTION IN PROCESSING FRAME-BASED DATA

(75) Inventor: Yuli You, Thousand Oaks, CA (US)

(73) Assignee: Digital Rise Technology Co., Ltd., Guangzhou, Guangdong Province (CN)

( * ) Notice: Subject to any disclaimer, the term of this patent is extended or adjusted under 35 U.S.C. 154(b) by 2220 days.

(21) Appl. No.: 11/558,917

(22) Filed: Nov. 12, 2006

(65) Prior Publication Data

US 2008/0059202 A1 Mar. 6, 2008

Related U.S. Application Data

(60) Provisional application No. 60/822,760, filed on Aug. 18, 2006.

(51) Int. Cl.
*G10L 19/00* (2013.01)

(52) U.S. Cl.
USPC ..... 704/500; 704/200.1; 704/201

(58) Field of Classification Search
USPC ..... 704/200.1, 201, 500
See application file for complete search history.

(56) References Cited

U.S. PATENT DOCUMENTS 5,214,742 A * 5/1993 Edler ..... 704/203
5,321,729 A 6/1994 Schroder et al.
5,394,473 A * 2/1995 Davidson ..... 704/200.1
5,848,391 A 12/1998 Bosi et al.
6,226,608 B1 5/2001 Fielder et al.
2003/0115052 A1* 6/2003 Chen et al. ..... 704/230
2004/0044520 A1* 3/2004 Chen et al. ..... 704/200.1
2004/0196913 A1* 10/2004 Chakravarthy et al. ..... 375/254
2005/0185850 A1* 8/2005 Vinton et al. ..... 382/240
2005/0192765 A1 9/2005 Slothers et al.

FOREIGN PATENT DOCUMENTS

WO WO9215153 A2 9/1992
WO WO/9245153 9/1992

OTHER PUBLICATIONS

Harris, "On the Use of Windows for Harmonic Analysis with the Discrete Fourier Transform," Proc IEEE, vol. 66, Jan. 1978, pp. 51-83.*
"0.8 1.2Vorbis I specification", downloaded from http://xiph.org/vorbis/doc/Vorbis_I _spec.pdf, 1994.
Ted Painter and Andreas Spanias, "Perceptual Coding of Digital Audio", Proceedings of the IEEE, vol. 88, No. 4, Apr. 2000, pp. 451-513.

* cited by examiner

*Primary Examiner* — Vijay B Chawan
(74) *Attorney, Agent, or Firm* — Joseph G. Swan, P.C.

(57) ABSTRACT

Provided are systems, methods and techniques for processing frame-based data. A frame of data, an indication that a transient occurs within the frame, and a location of the transient within the frame are obtained. Based on the indication of the transient, a block size is set for the frame, thereby effectively defining a plurality of equal-sized blocks within the frame. In addition, different window functions are selected for different ones of the plurality of equal-sized blocks based on the location of the transient, and the frame of data is processed by applying the selected window functions.

22 Claims, 6 Drawing Sheets

WIN_SHORT_BRIEF2BRIEF

WIN_SHORT_SHORT2BRIEF

WIN_SHORT_BRIEF2SHORT

WIN_LONG_LONG2BRIEF

WIN_LONG_BRIEF2LONG

WIN_LONG_BRIEF2BRIEF

WIN_LONG_SHORT2BRIEF

WIN_LONG_BRIEF2SHORT

WINDOW SELECTION BASED ON TRANSIENT DETECTION AND LOCATION TO PROVIDE VARIABLE TIME RESOLUTION IN PROCESSING FRAME-BASED DATA

This application claims the benefit of U.S. Provisional Patent Application Ser. No. 60/822,760, filed on Aug. 18, 2006, and titled "Variable-Resolution Filtering", which application is incorporated by reference herein as though set forth herein in full.

FIELD OF THE INVENTION

The present invention pertains to signal processing, such as processing of audio signals.

BACKGROUND

Many conventional signal-processing techniques are frame-based. In such techniques, a stream of data is divided into discrete frames, and the data within each such frame ordinarily is processed in a fairly uniform manner. In one example, an input audio signal is divided into frames of equal length. Then, each frame is processed in a particular manner. A common processing parameter to be determined for each frame is block length or, equivalently, into how many equal-sized blocks should the frame be divided for processing purposes. Block length determines resolution in the original domain (e.g., time for an audio signal) and in the frequency (or other transform) domain. More specifically, shorter block lengths provide greater resolution in the original domain and lesser resolution in the frequency domain.

An audio signal often consists of quasi-stationary episodes, each including a number of tonal frequency components, which are interrupted by dramatic transients. Thus, an individual frame of such an audio signal often will include a few samples corresponding to a transient, but with the vast majority of the samples corresponding to quasi-stationary portions of the signal.

Because transients in audio signals can be as short as a few of samples, the block size that is used within a frame that has been detected as including a transient ideally should be just a few samples as well, thereby matching the filter's temporal resolution to the transient. Unfortunately, it usually is not practical to use different block sizes within the same frame. Making all of the blocks within a frame having a detected transient just a few samples wide would result in extremely poor frequency resolution within the frame and, therefore, is inappropriate for the rest of the samples in the frame; that is, such other samples, provided they are sufficiently far away from the transient, are quasi-stationary and therefore are better processed using high frequency resolution. This conflict conventionally has resulted in a compromise block size that is optimal neither for the transient samples nor for the quasi-stationary samples in the same frame.

A block diagram of a conventional system for processing a frame of input samples 12 is illustrated in FIG. 1. Initially, samples 12 are analyzed in transient detector 14 to determine whether the frame includes a transient.

Based on that detection, a window function is selected in module 16. In this regard, audio-coding algorithms often employ a filter bank that has different temporal-frequency resolutions. One commonly used filter bank is the MDCT (Modified Discrete Cosine Transform), having an impulse response that can be described by the following basis function:

$$h(k, n) = w(n)\sqrt{\frac{2}{M}}\cos\left[\frac{\pi}{M}\left(n + \frac{M+1}{2}\right)\left(k + \frac{1}{2}\right)\right],$$

where k=0, 1, . . . , M−1; n=0, 1, . . . , 2M−1; and w(n) is a window function of length 2M. See, e.g., H. S. Malvar, "Signal Processing with Lapped Transforms", Artech House, 1992 (referred to herein as Malvar).

In this case, the temporal-frequency resolution is determined by M, which sometimes is referred to herein as block size. A large M means low temporal resolution but high frequency resolution, while a small M means high temporal resolution and low frequency resolution.

For purposes of implementing module 16 (as shown in FIG. 1), conventional coding algorithms typically use two block sizes. A large block size, implemented as a single block covering the entire frame, is used if no transient was detected in module 14. Alternatively, a small block size, implemented as a predetermined number of blocks covering the frame, is used if a transient was detected.

The principal window functions corresponding to these two block sizes are window function 30 (shown in FIG. 2 and labeled as WIN_LONG_LONG2LONG) and window function 40 (shown in FIG. 3 and labeled as WIN_SHORT_SHORT2SHORT), respectively. In order for the MDCT to be able to properly switch between these two principal window functions, the perfect reconstruction conditions (e.g., as described in Malvar) require the use of three transitional window functions, e.g.: window function 50 (shown in FIG. 16 and labeled as WIN_LONG_LONG2SHORT), window function 60 (shown in FIG. 5 and labeled as WIN_LONG_SHORT2LONG), and window function 70 (shown in FIG. 6 and labeled as WIN_LONG_SHORT2SHORT). It is noted that all three such transitional window functions 50, 60 and 70 are for use with the long block (i.e., covering an entire frame).

Thus, in the conventional techniques a frame is assigned a single long block (and corresponding long window 30, 50, 60 or 70) or a sequence of identical short blocks (and corresponding identical short windows 40). Because each block is longer than the block-to-block spacing, the result is an overlapping sequence of long and short windows, such as the sequence 80 of window functions shown in FIG. 7, with each window covering the M new samples of the current block together with M samples in the previous block. For reference purposes, the middle of each block corresponding to a window function 30, 40, 50, 60 or 70 is designated as 31, 41, 51, 61 or 71, respectively, in the drawings.

It is noted that such conventional techniques select the window function for a frame that does not include a transient, based not only on the detection made by module 14 for such current frame, but also based on similar detections made for the previous and subsequent frames. That is, window functions 50, 60 and 70 are used as transition window functions between transient frames and non-transient frames.

Referring back to FIG. 1, in module 17 the window function selected in module 16 is then applied (multiple times for a transient frame) to the input samples 12 for the current frame. That is, for each block the sample values are multiplied by the window function values corresponding to that block in order to obtain a set of weighted values.

Those weighted values are then processed in module 19 using the selected window function to provide the output values 22. The specific type of processing performed in module 19 can vary depending upon the desired application. For example, with respect to an audio signal, the processing might involve analysis, coding, and/or enhancement.

SUMMARY OF THE INVENTION

The present invention addresses this problem and others by, inter alia, using multiple different window functions within a frame that has been detected as including a transient. In the preferred embodiment, the present invention provides at least two levels of resolution within a single data frame having a detected transient. More preferably, such multiple resolutions are provided without changing the block size within the frame.

As a result, e.g., a higher resolution can be used in the vicinity of the transient and a lower resolution used in other portions of the frame. It is noted that unqualified use of the term "resolution" herein refers to resolution in the original (e.g., temporal) domain. Because resolution in the frequency (or other transform) domain varies inversely with a resolution in the original domain, in these embodiments of the invention a higher frequency (or other transform-domain) resolution is provided for portions of the frame that do not include the transient. Moreover, by holding block size constant, the foregoing advantages generally can be achieved without complicating the processing structure.

Thus, in one respect, the invention is directed to processing frame-based data, in which a frame of data, an indication that a transient occurs within the frame, and a location of the transient within the frame are obtained. Based on the indication of the transient, a block size is set for the frame, thereby effectively defining a plurality of equal-sized blocks within the frame. In addition, different window functions are selected for different ones of the plurality of equal-sized blocks based on the location of the transient, and the frame of data is processed by applying the selected window functions.

In the preferred embodiments, the blocks overlap each other, and each window function also overlaps each adjacent window function, preferably in a manner so as to satisfy the perfect reconstruction conditions. The foregoing properties preferably apply to adjacent blocks and window functions within a frame, as well as to adjacent blocks and window functions in adjacent frames.

In any case, the window functions preferably are selected to provide higher resolution within an identified one of the equal-sized blocks that includes the transient. Moreover, this preferably is achieved by using, within the identified block a transient window function that is narrower than others of the window functions (e.g., by zeroing samples within the block but outside of the transient window function). In other words, while the width of the block remains constant across the frame, the widths of the window functions within those blocks can be varied, if desired, to achieve the desired resolution trade-off (e.g., temporal/frequency) for each block of the frame.

In this regard, the width of a window function can be defined in a number of different ways. For example, it can be defined as the length of the non-zero portion of the window function, the length of that portion of the window function above a specified threshold, or the length of that portion of the window function that includes some specified percentage of the content (e.g., energy) of the window function.

Accordingly, the width of a window function can be varied by compressing or expanding a standard shape and then zeroing any samples within the block but not included within the compressed shape. Alternatively, the width can be varied by using different shapes, some with more of their energy concentrated in a smaller segment.

In another respect, the invention is directed to processing frame-based data, in which a frame of data, an indication that a transient occurs within the frame, and a location of the transient within the frame are obtained. Different window functions are selected for use within the frame so that higher resolution is provided within a region that includes the transient, and the frame of data is processed by applying the selected window functions.

The foregoing summary is intended merely to provide a brief description of the certain aspects of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 8:
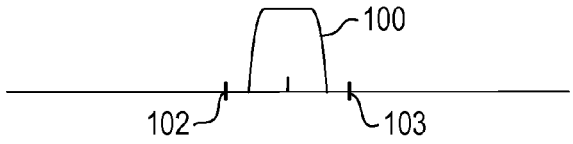
FIG. 8 illustrates a brief window function WIN_SHORT_BRIEF2BRIEF according to a representative embodiment of the present invention.

The present invention is directed primarily to improvements in the window function selection component 16 of the conventional systems. One feature of the present invention is the introduction of a new "brief window function", e.g., window function 100 as shown in FIG. 8. This window function 100, labeled as WIN_SHORT_BRIEF2BRIEF, is intended to be used within a short block, similar to conventional window function WIN_SHORT_SHORT2SHORT 40. In fact, as described in more detail below, in the preferred embodiments of the invention window function WIN_SHORT_BRIEF2BRIEF 100 is intended for use within the same frame as window function WIN_SHORT_SHORT2SHORT 40.

However, unlike conventional window functions, brief window function 100 uses for signal shaping only a central portion of the overall length of the block (having endpoints 102 and 103 in FIG. 8) it occupies, employing a number of leading and trailing zero weights, in order to improve its temporal resolution. For example, where the short block length=256 samples, the brief window function 100 preferably is nonzero within the central 160 samples (where it also is symmetric), with the first 16 and last 16 of such samples overlapping the respective transition window functions that are adjacent to it, and with zero weights for the first 48 samples and the last 48 samples of the window.

In the preferred embodiments of the invention, this brief window function 100 is only used where the transient samples within an audio frame have been detected (e.g., in the blocks that include transient samples), while the regular short window function (e.g., conventional window function 40), or one of the new transitional functions provided by the present invention, is applied to the quasi-stationary samples in the remainder of the frame. This allows for the following possibilities, as compared with conventional techniques:

- A significantly larger block size can be used, in which case the frequency resolution for the quasi-stationary samples is improved while the temporal resolution around the transient samples is left unchanged.
- The block size can be left unchanged, in which case the frequency resolution for the quasi-stationary samples is unchanged while the temporal resolution around the transient samples is improved.
- A somewhat larger block size can be used, in which case the frequency resolution for quasi-stationary samples is improved somewhat while the temporal resolution around the transient samples also is improved somewhat.

With any of the above choices, the compromise solution addressing the conflicting temporal-frequency resolution requirements is improved.

In order to facilitate the use of window function 100 in connection with the other two principal window functions, namely WIN_LONG_LONG2LONG 30 and WIN_SHORT_SHORT2SHORT 40 (e.g., in order to satisfy the perfect reconstruction conditions), additional transitional window functions preferably are introduced. Examples of such transitional window functions follow. Initially, however, it is noted that the present disclosure generally uses the nomenclature: WIN_BlockLength_PriorWF2SubsWF, where BlockLength indicates the length of the block occupied by the present window function (e.g., long or short), PriorWF identifies the type of window function in the immediately preceding block (e.g., long, short or brief), and SubsWF identifies the type of window function in the immediately subsequent block (e.g., long, short or brief).

Figure 9:
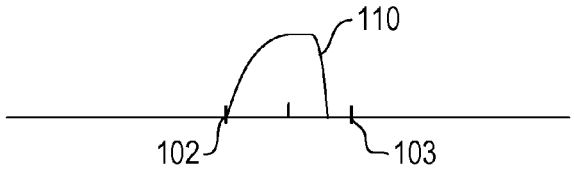
FIG. 9 illustrates a transitional window function WIN_SHORT_SHORT2BRIEF according to a representative embodiment of the present invention.

Transitional window function 110 (shown in FIG. 9 and labeled as WIN_SHORT_SHORT2BRIEF) is for use within a short block immediately preceding another short block that includes the transient. That is, it immediately precedes window function WIN_SHORT_BRIEF2BRIEF 100.

Figure 10:
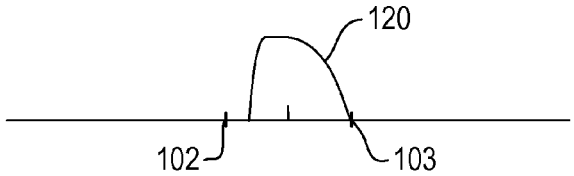
FIG. 10 illustrates a transitional window function WIN_SHORT_BRIEF2SHORT according to a representative embodiment of the present invention.

Window function 120 (shown in FIG. 10 and labeled as WIN_SHORT_BRIEF2SHORT) is for use within a short block immediately following another short block that includes the transient. That is, it immediately follows window function WIN_SHORT_BRIEF2BRIEF 100.

Figure 11:
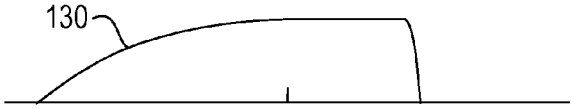
FIG. 11 illustrates a transitional window function WIN_LONG_LONG2BRIEF according to a representative embodiment of the present invention.

Window function 130 (shown in FIG. 11 and labeled as WIN_LONG_LONG2BRIEF) is for use within a long block immediately preceding a short block that includes the transient. That is, it covers a frame immediately preceding a subsequent frame that includes a transient, the transient being within the very first block of the subsequent frame.

Figure 12:
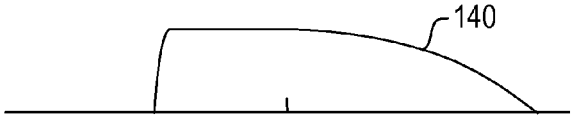
FIG. 12 illustrates a transitional window function WIN_LONG_BRIEF2LONG according to a representative embodiment of the present invention.

Window function 140 (shown in FIG. 12 and labeled as WIN_LONG_BRIEF2LONG) is for use within a long block immediately following a short block that includes the transient. That is, it covers a frame immediately following a preceding frame that includes a transient, the transient being within the very last block of the preceding frame.

Figure 13:
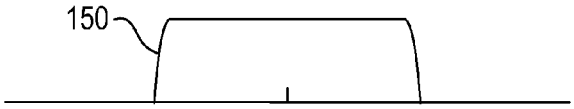
FIG. 13 illustrates a transitional window function WIN_LONG_BRIEF2BRIEF according to a representative embodiment of the present invention.

Window function 150 (shown in FIG. 13 and labeled as WIN_LONG_BRIEF2BRIEF) is for use within a long block sandwiched between two short blocks that include transients. That is, it covers a frame between two frames that include transients, the transient in the preceding frame being within its very last block and the transient in the subsequent frame being within its very first block.

Figure 14:
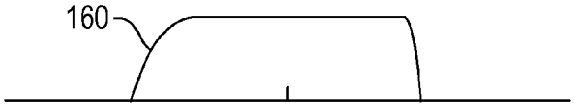
FIG. 14 illustrates a transitional window function WIN_LONG_SHORT2BRIEF according to a representative embodiment of the present invention.

Window function 160 (shown in FIG. 14 and labeled as WIN_LONG_SHORT2BRIEF) is for use within a long block covering a frame between two frames that include transients, the transient in the preceding frame being somewhere other than its very last block and the transient in the subsequent frame being within its very first block.

Figure 15:
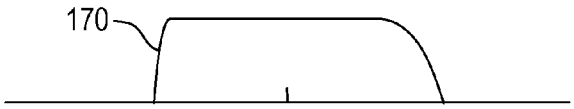
FIG. 15 illustrates a transitional window function WIN_LONG_BRIEF2SHORT according to a representative embodiment of the present invention.

Window function 170 (shown in FIG. 15 and labeled as WIN_LONG_BRIEF2SHORT) is for use within a long block covering a frame between two frames that include transients, the transient in the preceding frame being within its very last block and the transient in the subsequent frame being somewhere other than its very first block.

In each case, the window function preferably is designed so that it overlaps the adjacent window function on each side in a manner so as to satisfy the perfect reconstruction conditions. Specific examples of window functions that may be used are given below.

Figure 16:
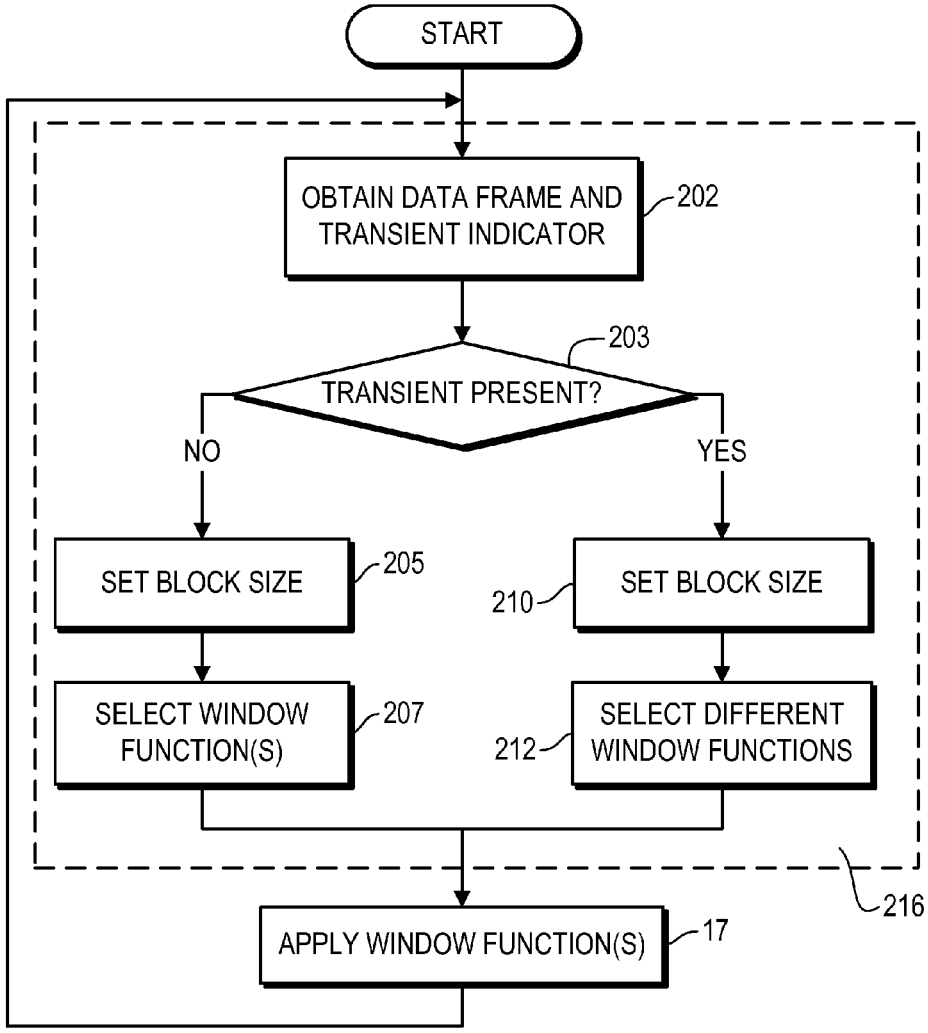
FIG. 16 is a flow diagram illustrating a technique for selecting window functions according to a representative embodiment of the present invention.
Figure 17:
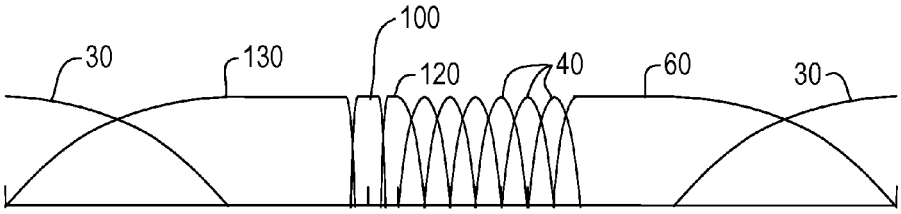
FIG. 17 illustrates a first exemplary window function sequence according to the present invention.
Figure 18:
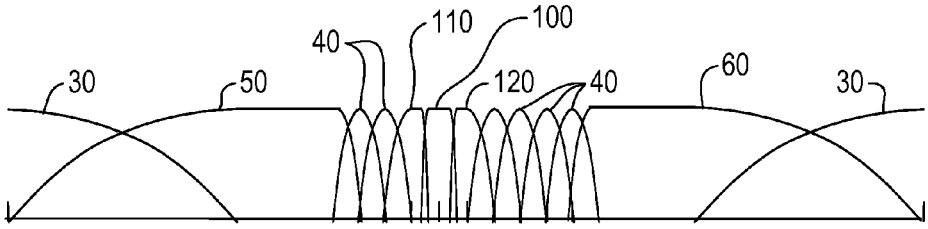
FIG. 18 is illustrates a second exemplary window function sequence according to the present invention.
Figure 19:
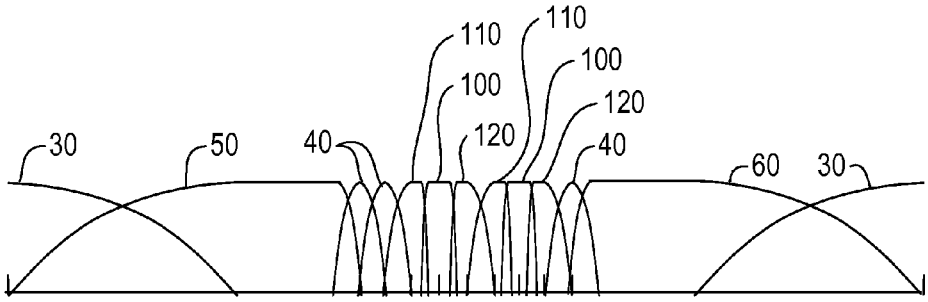
FIG. 19 illustrates a third exemplary window function sequence according to the present invention.
Figure 20:
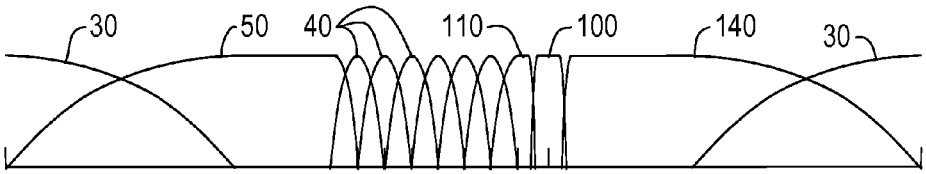
FIG. 20 illustrates a fourth exemplary window function sequence according to the present invention.

FIG. 16 is a flow diagram illustrating a technique for selecting window functions according to a representative embodiment of the present invention. Generally speaking, the entire process illustrated in FIG. 16 will be automated (e.g., implemented in software, firmware, dedicated hardware or any combination thereof).

Initially, in step 202 a frame of data is obtained. In this regard, a variety of different types of data may be processed according to the present invention. Throughout this disclosure, it often is assumed that the data correspond to an audio signal. However, this should not be taken as limiting and the obtained data instead may be representative of any other physical phenomena, such as an image signal, a video signal, or a signal representative of heat, pressure, radiation, motion, distance, any biological function, weather and/or any geological phenomenon.

Also, it should be noted that the data frame may have been defined by the source of the data (e.g., as where data are being received over a communication channel). Alternatively, e.g., the data may be received in a continuous stream and segmented (e.g., internally) into frames for processing purposes. In any event, the present processing is particularly (although not exclusively) applicable to data which are separated into individual frames. As indicated above, frame-based processing allows individual portions of the overall data stream to be processed in a uniform manner in some particular respects.

In the preferred embodiments of the present invention, each frame has a uniform block size. In this regard, the block preferably is defined as the basic signal-processing unit for the frame. For example, in the event that the data within the frame are to be transformed (e.g., in the signal-processing module 19) from the original domain (e.g., the time domain in the event of an audio signal) to the frequency domain (e.g., using a Discrete Cosine Transform or a Fast Fourier Transform), or to any other transform domain defined by a set of orthogonal functions, the transformation and any subsequent processing within the transform domain preferably are performed separately for each block.

Thus, in the preferred embodiments a frame might be covered by a single block or, alternatively, might be covered by a plurality of equal-sized blocks. More preferably, as with the conventional techniques, there are only two block sizes: a large block size that covers an entire frame and a small block size resulting in a plurality of contiguous blocks that are uniformly distributed throughout the frame.

Moreover, in order to address boundary problems that otherwise would occur, as with the conventional techniques, the blocks of the present invention preferably overlap each other (e.g., in a manner satisfying the perfect reconstruction conditions). Conceptually, each block can be thought of as including a number of core samples that subsequently are to be processed (e.g., in module 19) and a number of boundary samples adjacent to such core samples. In the preferred embodiments, the core samples are new samples in the sequence and the boundary samples are historic samples from the preceding block. The frames, on the other hand, preferably are contiguous and non-overlapping. As a result, the block at the beginning of a frame overlaps the preceding frame. For frames covered by a single block, that single block overlaps the entire preceding frame.

In addition to obtaining the data frame itself, step 202 also obtains a transient indicator (e.g., from transient detector 14). In the preferred embodiment, the obtained transient indicator indicates whether a transient is present in the current frame and, if so, where in the frame it is. If more than one transient has been detected in the current frame, then the location of each such transient preferably is obtained (e.g., identified by and then received from transient detector 14). In order to simplify the explanation, the present disclosure sometimes assumes, without loss of generality, that only a single transient (if any) is detected in each frame.

The actual detection of transients can be performed using, e.g., any existing techniques. Ordinarily, a transient will manifest itself as a spike in high-frequency components over a very short period of time and, therefore, can be detected on this basis. In any event, a threshold level often will be specified, below which signal activity will not be deemed a transient.

Referring back to FIG. 16, in step 203 a determination is made as to whether a transient exists in the present frame. Preferably, this determination is straightforward based on the information provided by transient detector 14. If a transient is not present, then processing proceeds to step 205. If one is, then processing proceeds to step 210.

In step 205, the block size is set based on the determination that the present frame does not include a transient. In the preferred embodiments, a single block is used to cover the entire frame in such a case. More preferably, the block includes all of the samples in the current frame as the core samples, as well as part or all of the samples from the preceding frame(s). An exemplary block size is 2,048 samples, i.e., 1,024 core samples (frame size also being 1,024 samples) and 1,024 samples from the preceding frame.

Next, in step 207 the window function is selected for the current frame (assuming a single block is to cover the entire frame). In the preferred embodiments, this step involves evaluating the immediately preceding and immediately subsequent frames/blocks. Due to the increased number of window functions, as compared with conventional techniques, the determination of the appropriate window sequence typically is somewhat more complicated, but the underlying principle is relatively straightforward. Specifically, a long window function is selected, with the specific shape depending on the existence and location of any transient in the previous and next frame. The specific selection preferably is made as follows:

| Previous Frame | Current Frame | Next Frame |
|---|---|---|
| No Transient | WIN_LONG_LONG2LONG 30 | No Transient |
| | WIN_LONG_LONG2SHORT 50 | Transient, but not in the first block |
| | WIN_LONG_LONG2BRIEF 130 | Transient in the first block |
| Transient, but not in the last MDCT block | WIN_LONG_SHORT2LONG 60 | No Transient |
| | WIN_LONG_SHORT2SHORT 70 | Transient, but not in the first block |
| | WIN_LONG_SHORT2BRIEF 160 | Transient in the first block |
| Transient in the last MDCT block | WIN_LONG_BRIEF2LONG 140 | No Transient |
| | WIN_LONG_BRIEF2SHORT 170 | Transient, but not in the first block |
| | WIN_LONG_BRIEF2BRIEF 150 | Transient in the first block |

Once the appropriate window function has been selected in step 207, it is applied in step 17 (e.g., as discussed above).

On the other hand, if it were determined in step 203 that a transient exists in the current frame, then processing would have proceeded to step 210, in which the block size is set to "small". One example, for a frame size of 1,024 samples, is a block size of 256 samples, i.e., 128 core samples and 128 samples overlapping with the preceding block (so that the frame is covered by 8 blocks). Although the present embodiment contemplates a single block size for each of the two possible situations (transient/no transient), it should be noted that in other embodiments different block sizes may be selected based on any desired criteria, and a frame may consist of blocks of different sizes.

In any event, once the block size has been established, processing proceeds to step 212, in which different window functions are selected for the different blocks within the current frame. Because it is known that the current frame includes at least one transient, the WIN_SHORT_BRIEF2BRIEF window function 100 will be used at least once (at the identified location(s)). More preferably, a sequence of brief and short window functions are selected for the short blocks of the current frame according to the following principles:

WIN_SHORT_BRIEF2BRIEF is applied to samples in the block where a transient occurs, in order to improve the temporal resolution of the block.

The window function for the window that is immediately before the window that includes the transient has a designation of the form " . . . 2BRIEF".

The window function for the window that is immediately after the window that includes the transient has a designation of the form " . . . _BRIEF2 . . . ".

Consequently, any of the following combinations of window functions is permissible:

| Pre-Transient | Transient | Post-Transient |
|---|---|---|
| WIN__LONG__LONG2BRIEF | WIN__SHORT__BRIEF2BRIEF | WIN__LONG__BRIEF2LONG |
| WIN__LONG__SHORT2BRIEF | | WIN__LONG__BRIEF2SHORT |
| WIN__LONG__BRIEF2BRIEF | | WIN__LONG__BRIEF2BRIEF |
| WIN__SHORT__SHORT2BRIEF | | WIN__SHORT__BRIEF2SHORT |
| WIN__SHORT__BRIEF2BRIEF | | WIN__SHORT__BRIEF2BRIEF |

A specific procedure, written in C, for placing window functions within a frame is set forth in the section of this disclosure titled, "Window Function Selection Routine". Generally speaking, however, the pre-transient transitional window function is selected from the left column in the above table based on its own block length (long or short) and the nature of the window function immediately preceding it (long, short or brief). Similarly, the post-transient transitional window function is selected from the right column in the above table based on its own block length (long or short) and the nature of the window function immediately following it (long, short or brief). Each block within the current frame that is not (i) pre-transient (a block immediately preceding a transient block), (ii) transient (a block that includes a transient), (iii) post-transient (a block that immediately follows a transient block), (iv) the first block of the frame, or (v) the last block of the frame preferably is assigned a window function of WIN_SHORT_SHORT2SHORT 40. The first block in the current frame (assuming it is not a pre-transient, transient or post-transient block) preferably is assigned a window function of WIN_SHORT_PriorWF2SHORT, and the last block in the current frame (assuming it is not a pre-transient, transient or post-transient block) preferably is assigned a window function of WIN_SHORT_SHORT2SubsWF.

Upon completion of step 212, processing proceeds to step 17 to apply the selected window functions. Upon completion of step 17, processing returns to step 202 to process the next frame.

It should be understood that the flow diagram shown in FIG. 16 primarily is conceptual in nature. In fact, as indicated above, the selection of window function(s) for one frame typically will be affected by the presence and location of transients in adjacent frames. Accordingly, the selection of window function(s) for one frame may be performed concurrently with the selection of window function(s) for one or more other frames. At the very least, the selection for a current frame preferably is in anticipation of the window function that will be applied to a subsequent frame.

Figure 1:
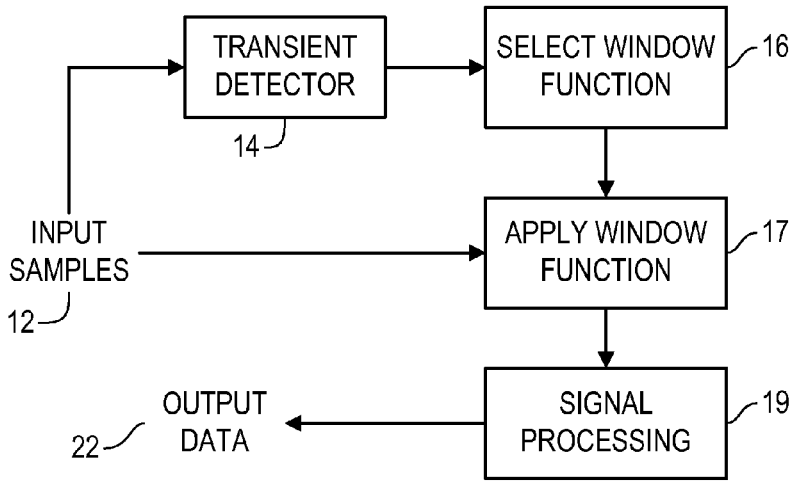
FIG. 1 (Prior Art)
FIG. 1 is a block diagram of a conventional system for modifying temporal resolution within a data frame based on the existence of transients.
Figure 2:
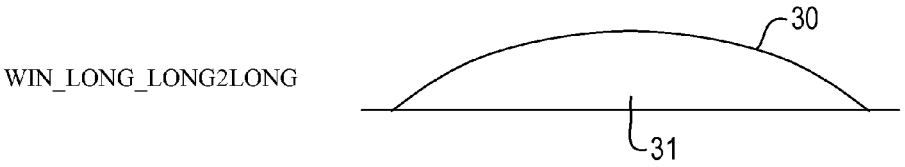
FIG. 2 (Prior Art)
FIG. 2 illustrates a conventional window function for a frame having a long block size, when sandwiched between two frames also having a long block size.
Figure 3:
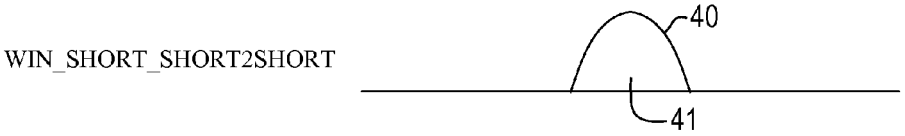
FIG. 3 (Prior Art)
FIG. 3 illustrates a conventional window function for a frame having a short block size.
Figure 4:
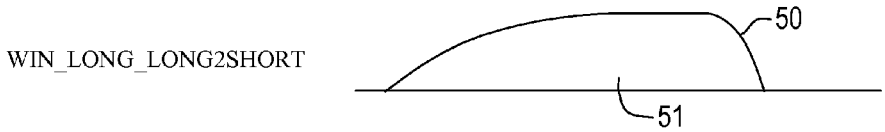
FIG. 4 (Prior Art)
FIG. 4 illustrates a conventional transitional window function for a frame having a long block size, when preceded by a frame having a long block size and followed by a frame having a short block size.
Figure 5:
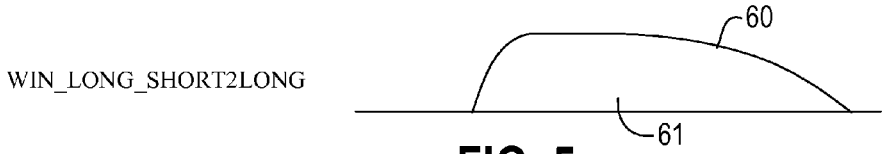
FIG. 5 (Prior Art)
FIG. 5 illustrates a conventional transitional window function for a frame having a long block size, when preceded by a frame having a short block size and followed by a frame having a long block size.
Figure 6:
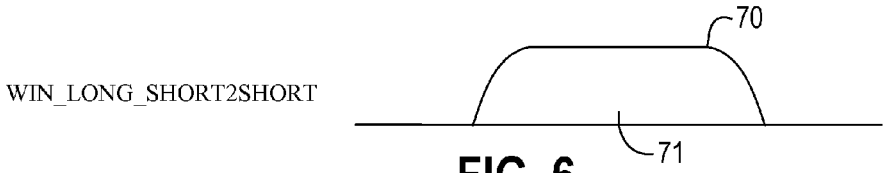
FIG. 6 (Prior Art)
FIG. 6 illustrates a conventional transitional window function for a frame having a long block size, when preceded by a frame having a short block size and followed by a frame having a short block size.

It is noted that the portion 216 of the flow diagram shown in FIG. 16 can used in place of corresponding processing performed in conventional window-function selection module 16 (in FIG. 1). As a result, the techniques of the present invention typically can be easily incorporated as an improvement to conventional systems.

One application in which the present invention may be used is for audio coding/decoding. Within such a system, the encoder typically indicates to the decoder the window function that it used to encode the current frame so that the decoder can use the same window function to decode the frame. With conventional techniques, only one window function index generally needs to be transmitted to the decoder to accomplish this purpose because:

For a frame without a detected transient, only one of the long window functions is used, and hence needs to be indicated to the decoder.

Figure 7:
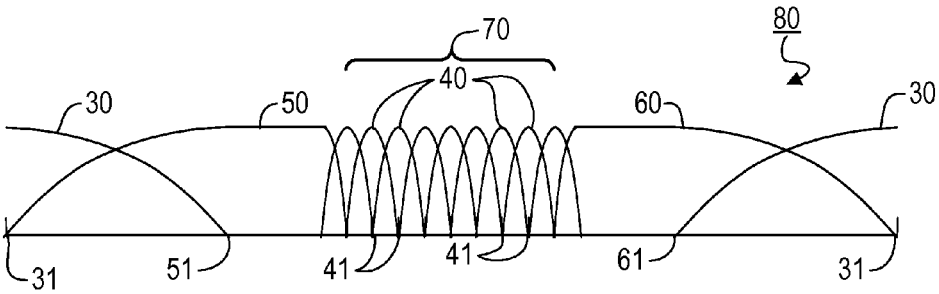
FIG. 7 (Prior Art)
FIG. 7 illustrates an exemplary conventional sequence of window functions, in which a frame that includes a transient is bordered on each side by two frames that do not include a transient.

For a frame that includes one or more transients, all the window functions within the frame are the same, namely, WIN_SHORT_SHORT2SHORT 40. Such a frame 70 (which is sandwiched between two frames without a detected transient) is illustrated in FIG. 7.

The statement above also is true for the technique of the present invention. That is, only one window function index needs to be transmitted to the decoder in order for the decoder to use the same window functions as the encoder to decode the frame. This is because:

For a frame without a detected transient, the present technique also needs only to indicate to the decoder which one of the long window functions is used.

For a frame with a detected transient, the encoder only needs to indicate to the decoder if there is a transient in the first block of the current frame and if there is a transient in the first block of the next frame; then, the sequence of window functions for the whole frame can be determined using the procedures described herein. Because the WIN_SHORT_BRIEF2BRIEF window function 100 is used for a block with a transient in the preferred embodiments, the following nomenclature may be used to convey this message: WIN_SHORT_CurrentSubs, where Current (SHORT=no, BRIEF=yes) identifies if there is transient in the first block of current frame, and Subs (SHORT=no, BRIEF=yes) identifies if there is transient in the first block of the subsequent frame. For example, WIN_SHORT_BRIEF2BRIEF indicates that there is transient in the first block of the current frame and in the first block of the subsequent frame, and WIN_SHORT_BRIEF2SHORT indicates that there is transient in the first block of the current frame but not in the first block of the subsequent frame.

FIGS. 17-20 illustrate exemplary window function sequences according to the present invention. In each such sequence, a frame having at least one transient (as indicated by WIN_SHORT_BRIEF2BRIEF window function 100) is surrounded by two frames on each side that do not include a transient. However, these examples are not to be taken as limiting; consecutive frames, each having at least one transient, also are allowed.

Exemplary Implementation

One widely used window function is the following sine function:

$$w(n) = \sin\left[\frac{\pi}{2M}\left(n + \frac{1}{2}\right)\right].$$

If M=L for long window function, M=S for short window function, and M=B for brief window function, where L>S>B, then the following window functions can be defined: WIN LONG LONG2LONG:

$$w(n) = \sin\left[\frac{\pi}{2L}\left(n + \frac{1}{2}\right)\right],\ 0 \le n < 2L.$$

WIN_LONG_LONG2SHORT:

$$w(n) = \begin{cases} \sin\left[\frac{\pi}{2L}\left(n + \frac{1}{2}\right)\right], & 0 \le n < L; \\ 1, & L \le n < \frac{3L - S}{2}; \\ \sin\left[\frac{\pi}{2S}\left(\left(n - \frac{3L - 3S}{2}\right) + \frac{1}{2}\right)\right], & \frac{3L - S}{2} \le n < \frac{3L + S}{2}; \\ 0, & \frac{3L + s}{2} \le n < 2L. \end{cases}$$

WIN_LONG_SHORT2LONG:

$$w(n) = \begin{cases} 0, & 0 \le n < \frac{L - S}{2}; \\ \sin\left[\frac{\pi}{2S}\left(\left(n - \frac{L - S}{2}\right) + \frac{1}{2}\right)\right], & \frac{L - S}{2} \le n < \frac{L + S}{2}; \\ 1, & \frac{L + S}{2} \le n < L; \\ \sin\left[\frac{\pi}{2L}\left(n + \frac{1}{2}\right)\right], & L \le n < 2L. \end{cases}$$

WIN_SHORT_SHORT2SHORT:

$$w(n) = \begin{cases} 0, & 0 \le n < \frac{L - S}{2}; \\ \sin\left[\frac{\pi}{2S}\left(\left(n - \frac{L - S}{2}\right) + \frac{1}{2}\right)\right], & \frac{L - S}{2} \le n < \frac{L + S}{2}; \\ 1, & \frac{L + S}{2} \le n < \frac{3L - S}{2}; \\ \sin\left[\frac{\pi}{2S}\left(\left(n - \frac{3L - 3S}{2}\right) + \frac{1}{2}\right)\right], & \frac{3L - S}{2} \le n < \frac{3L + S}{2}; \\ 0, & \frac{3L + S}{2} \le n < 2L. \end{cases}$$

WIN_SHORT_SHORT2SHORT:

$$w(n) = \sin\left[\frac{\pi}{2S}\left(n + \frac{1}{2}\right)\right],\ 0 \le n < 2S.$$

WIN_SHORT_BRIEF2BRIEF:

$$w(n) = \begin{cases} 0, & 0 \le n < \frac{S - B}{2}; \\ \sin\left[\frac{\pi}{2B}\left(\left(n - \frac{S - B}{2}\right) + \frac{1}{2}\right)\right], & \frac{S - B}{2} \le n < \frac{S + B}{2}; \\ 1, & \frac{S + B}{2} \le n < \frac{3S - B}{2}; \\ \sin\left[\frac{\pi}{2B}\left(n - \frac{3S - 3B}{2}\right) + \frac{1}{2}\right], & \frac{3S - B}{2} \le n < \frac{3S + B}{2}, \\ 0, & \frac{3S + B}{2} \le n < 2S \end{cases}$$

WIN_LONG_LONG2BRIEF:

$$w_1(n) = \begin{cases} \sin\left[\frac{\pi}{2L}\left(n + \frac{1}{2}\right)\right], & 0 \le n < L; \\ 1, & L \le n < \frac{3L - B}{2}; \\ \sin\left[\frac{\pi}{2B}\left(\left(n - \frac{3L - 3B}{2}\right) + \frac{1}{2}\right)\right], & \frac{3L - B}{2} \le n < \frac{3L + B}{2}; \\ 0, & \frac{3L + B}{2} \le n < 2L. \end{cases}$$

WIN_LONG_BRIEF2LONG:

$$w_1(n) = \begin{cases} 0, & 0 \le n < \frac{L - B}{2}; \\ \sin\left[\frac{\pi}{2B}\left(\left(n - \frac{L - B}{2}\right) + \frac{1}{2}\right)\right], & \frac{L - B}{2} \le n < \frac{L + B}{2}; \\ 1, & \frac{L + B}{2} \le n < L; \\ \sin\left[\frac{\pi}{2L}\left(n + \frac{1}{2}\right)\right], & L \le n < 2L. \end{cases}$$

WIN_LONG_BRIEF2BRIEF:

$$w(n) = \begin{cases} 0, & 0 \le n < \frac{L - B}{2}; \\ \sin\left[\frac{\pi}{2B}\left(\left(n - \frac{L - B}{2}\right) + \frac{1}{2}\right)\right], & \frac{L - B}{2} \le n < \frac{L + B}{2}; \\ 1, & \frac{L + B}{2} \le n < \frac{3L - B}{2}; \\ \sin\left[\frac{\pi}{2B}\left(n - \frac{3L - 3B}{2}\right) + \frac{1}{2}\right], & \frac{3L - B}{2} \le n < \frac{3L + B}{2}; \\ 0, & \frac{3L + B}{2} \le n < 2L. \end{cases}$$

WIN_LONG_SHORT2BRIEF:

$$w(n)=\begin{cases}0, & 0\le n<\frac{L-S}{2};\\ \sin\left[\frac{\pi}{2S}\left(\left(n-\frac{L-S}{2}\right)+\frac{1}{2}\right)\right], & \frac{L-S}{2}\le n<\frac{L+S}{2};\\ 1, & \frac{L+S}{2}\le n<\frac{3L-B}{2};\\ \sin\left[\frac{\pi}{2B}\left(\left(n-\frac{3L-3B}{2}\right)+\frac{1}{2}\right)\right], & \frac{3L-B}{2}\le n<\frac{3L+B}{2};\\ 0, & \frac{3L+B}{2}\le n<2L.\end{cases}$$

WIN_LONG_BRIEF2SHORT:

$$w(n)=\begin{cases}0, & 0\le n<\frac{L-B}{2};\\ \sin\left[\frac{\pi}{2B}\left(\left(n-\frac{L-B}{2}\right)+\frac{1}{2}\right)\right], & \frac{L-B}{2}\le n<\frac{L+B}{2};\\ 1, & \frac{L+B}{2}\le n<\frac{3L-S}{2};\\ \sin\left[\frac{\pi}{2S}\left(\left(n-\frac{3L-3S}{2}\right)+\frac{1}{2}\right)\right], & \frac{3L-S}{2}\le n<\frac{3L+S}{2};\\ 0, & \frac{3L+S}{2}\le n<2L.\end{cases}$$

WIN_SHORT_SHORT2BRIEF:

$$w(n)=\begin{cases}\sin\left[\frac{\pi}{2S}\left(n+\frac{1}{2}\right)\right], & 0\le n<S;\\ 1, & S\le n<\frac{3S-B}{2};\\ \sin\left[\frac{\pi}{2B}\left(\left(n-\frac{3S-3B}{2}\right)+\frac{1}{2}\right)\right], & \frac{3S-B}{2}\le n<\frac{3S+B}{2};\\ 0, & \frac{3S+B}{2}\le n<2S.\end{cases}$$

WIN_SHORT_BRIEF2SHORT:

$$w(n)=\begin{cases}0, & 0\le n<\frac{S-B}{2};\\ \sin\left[\frac{\pi}{2B}\left(\left(n-\frac{S-B}{2}\right)+\frac{1}{2}\right)\right], & \frac{S-B}{2}\le n<\frac{S+B}{2};\\ 1, & \frac{S+B}{2}\le n<S;\\ \sin\left[\frac{\pi}{2S}\left(n+\frac{1}{2}\right)\right], & S\le n<2S.\end{cases}$$

A good set of window length parameters is L=1024, S=128, and B=32. However, other parameters instead may be used.

System Environment.

Generally speaking, except where clearly indicated otherwise, all of the systems, methods and techniques described herein can be practiced with the use of one or more programmable general-purpose computing devices. Such devices typically will include, for example, at least some of the following components interconnected with each other, e.g., via a common bus: one or more central processing units (CPUs); read-only memory (ROM); random access memory (RAM); input/output software and circuitry for interfacing with other devices (e.g., using a hardwired connection, such as a serial port, a parallel port, a USB connection or a firewire connection, or using a wireless protocol, such as Bluetooth or a 802.11 protocol); software and circuitry for connecting to one or more networks (e.g., using a hardwired connection such as an Ethernet card or a wireless protocol, such as code division multiple access (CDMA), global system for mobile communications (GSM), Bluetooth, a 802.11 protocol, or any other cellular-based or non-cellular-based system), which networks, in turn, in many embodiments of the invention, connect to the Internet or to any other networks); a display (such as a cathode ray tube display, a liquid crystal display, an organic light-emitting display, a polymeric light-emitting display or any other thin-film display); other output devices (such as one or more speakers, a headphone set and a printer); one or more input devices (such as a mouse, touchpad, tablet, touch-sensitive display or other pointing device, a keyboard, a keypad, a microphone and a scanner); a mass storage unit (such as a hard disk drive); a real-time clock; a removable storage read/write device (such as for reading from and writing to RAM, a magnetic disk, a magnetic tape, an opto-magnetic disk, an optical disk, or the like); and a modem (e.g., for sending faxes or for connecting to the Internet or to any other computer network via a dial-up connection). In operation, the process steps to implement the above methods and functionality, to the extent performed by such a general-purpose computer, typically initially are stored in mass storage (e.g., the hard disk), are downloaded into RAM and then are executed by the CPU out of RAM. However, in some cases the process steps initially are stored in RAM or ROM.

Suitable devices for use in implementing the present invention may be obtained from various vendors. In the various embodiments, different types of devices are used depending upon the size and complexity of the tasks. Suitable devices include mainframe computers, multiprocessor computers, workstations, personal computers, and even smaller computers such as PDAs, wireless telephones or any other appliance or device, whether stand-alone, hard-wired into a network or wirelessly connected to a network.

In addition, although general-purpose programmable devices have been described above, in alternate embodiments one or more special-purpose processors or computers instead (or in addition) are used. In general, it should be noted that, except as expressly noted otherwise, any of the functionality described above can be implemented in software, hardware, firmware or any combination of these, with the particular implementation being selected based on known engineering tradeoffs. More specifically, where the functionality described above is implemented in a fixed, predetermined or logical manner, it can be accomplished through programming (e.g., software or firmware), an appropriate arrangement of logic components (hardware) or any combination of the two, as will be readily appreciated by those skilled in the art.

It should be understood that the present invention also relates to machine-readable media on which are stored program instructions for performing the methods and functionality of this invention. Such media include, by way of example, magnetic disks, magnetic tape, optically readable media such as CD ROMs and DVD ROMs, or semiconductor memory such as PCMCIA cards, various types of memory cards, USB memory devices, etc. In each case, the medium may take the form of a portable item such as a miniature disk drive or a small disk, diskette, cassette, cartridge, card, stick etc., or it may take the form of a relatively larger or immobile item such as a hard disk drive, ROM or RAM provided in a computer or other device.

The foregoing description primarily emphasizes electronic computers and devices. However, it should be understood that any other computing or other type of device instead may be used, such as a device utilizing any combination of electronic, optical, biological and chemical processing.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

Window Function Selection Routine.

```
if ( nWinTypeFirst==WIN_SHORT_SHORT2SHORT
   || nWinTypeFirst==WIN_SHORT_SHORT2BRIEF )
{
   pnWinTypeShort[0] = WIN_SHORT_SHORT2SHORT;
   switch ( nWinTypeLast )
   {
   case WIN_SHORT_BRIEF2BRIEF:
      pnWinTypeShort[0] = WIN_SHORT_BRIEF2SHORT;
      break;
   case WIN_LONG_LONG2SHORT:
   case WIN_LONG_SHORT2SHORT:
   case WIN_LONG_BRIEF2SHORT:
   case WIN_SHORT_SHORT2SHORT:
   case WIN_SHORT_BRIEF2SHORT:
      break;
   default:
      ErroHandling( );
   }
}
else {
   pnWinTypeShort[0] = WIN_SHORT_BRIEF2BRIEF;
   switch ( nWinTypeLast )
   {
   case WIN_SHORT_BRIEF2BRIEF:
   case WIN_SHORT_SHORT2BRIEF:
   case WIN_LONG_LONG2BRIEF:
   case WIN_LONG_BRIEF2BRIEF:
   case WIN_LONG_SHORT2BRIEF:
      break;
   default:
      ErroHandling( );
   }
   }
   for (nBlock=1; nBlock<nNumBlocksPerFrm; nBlock++)
   {
      pnWinTypeShort[nBlock] = WIN_SHORT_SHORT2SHORT;
   }
   nBlock = 0;
   for (nCluster=0; nCluster<nNumCluster-1; nCluster++)
   {
      nBlock += anNumBlocksPerCluster[nCluster];
      pnWinTypeShort[nBlock] = WIN_SHORT_BRIEF2BRIEF;
   }
   if ( pnWinTypeShort[0] == WIN_SHORT_BRIEF2BRIEF )
   {
      if ( pnWinTypeShort[1]==WIN_SHORT_SHORT2SHORT )
      {
         pnWinTypeShort[1] = WIN_SHORT_BRIEF2SHORT;
      }
   }
   for (nBlock=1; nBlock<nNumBlocksPerFrm-1; nBlock++)
   {
      if ( pnWinTypeShort[nBlock] == WIN_SHORT_BRIEF2BRIEF )
      {
         if ( pnWinTypeShort[nBlock-1] ==
WIN_SHORT_SHORT2SHORT )
         {
            pnWinTypeShort[nBlock-1] =
```

-continued

```
WIN_SHORT_SHORT2BRIEF;
        }
        if ( pnWinTypeShort[nBlock−1] ==
WIN_SHORT_BRIEF2SHORT )
        {
          pnWinTypeShort[nBlock−1] =
WIN_SHORT_BRIEF2BRIEF;
        }
        if (
pnWinTypeShort[nBlock+1]==WIN_SHORT_SHORT2SHORT )
        {
          pnWinTypeShort[nBlock+1] =
WIN_SHORT_BRIEF2SHORT;
        }
      }
    }
    switch ( pnWinTypeShort[nBlock] )
    {
    case WIN_SHORT_BRIEF2BRIEF:
      if ( pnWinTypeShort[nBlock−1] == WIN_SHORT_SHORT2SHORT )
      {
        pnWinTypeShort[nBlock−1] = WIN_SHORT_SHORT2BRIEF;
      }
        if ( pnWinTypeShort[nBlock−1] == WIN_SHORT_BRIEF2SHORT )
      {
        pnWinTypeShort[nBlock−1] = WIN_SHORT_BRIEF2BRIEF;
      }
      break;
    case WIN_SHORT_SHORT2SHORT:
      if ( nWinTypeFirst==WIN_SHORT_SHORT2BRIEF
        || nWinTypeFirst==WIN_SHORT_BRIEF2BRIEF )
      {
        pnWinTypeShort[nBlock] = WIN_SHORT_SHORT2BRIEF;
      }
      break;
    case WIN_SHORT_BRIEF2SHORT:
      if ( nWinTypeFirst==WIN_SHORT_SHORT2BRIEF
        || nWinTypeFirst==WIN_SHORT_BRIEF2BRIEF )
      {
        pnWinTypeShort[nBlock] = WIN_SHORT_BRIEF2BRIEF;
      }
      break;
      default:
        ErroHandling( );
      }
    where:
```

| Variable | Explanation |
|---|---|
| nWinTypeFirst | Indicates if there is transient in the first block of the current frame and in the first block of the next frame. |
| nWinTypeLast | Window function for the last block in the last Frame. |
| pnWinTypeShort[nBlock] | Window function for the nBlock-th block. |
| nNumBlocksPerFrm | Number of blocks in a frame. |
| nNumCluster | Number of transient clusters in a frame. A transient cluster starts with a transient and ends before the start of the next transient or the end of the frame. |
| anNumBlocksPerCluster[nCluster] | Number of blocks in the nCluster-th cluster whose first block contains the transient. |
| ErroHandling( ) | Any error handling function defined by user. |

What is claimed is:

1. A non-transitory computer-readable storage medium storing computer-executable process steps for processing frame-based audio data, said process steps comprising:

(a) obtaining a frame of audio data, an indication that a transient occurs within the frame, and a location of the transient within the frame;

(b) setting a block size of 256 samples for the frame based on the indication of the transient, thereby effectively defining a plurality of equal-sized blocks within the frame;

(c) selecting a brief window function for a block within the frame that includes the transient; and (d) processing the frame of audio data by applying the brief window function as selected in step (c), wherein the brief window function includes a rising portion followed by a substantially constant portion followed by a falling portion, and wherein the rising portion and the falling portion of the brief window function are each 32 samples long.

2. A non-transitory computer-readable storage medium according to claim 1, wherein the brief window function includes exactly 48 zero weights immediately before the rising portion, which are applied to the first samples of the transient block, and also includes 48 zero weights immediately after the falling portion, which are applied to the last samples of the transient block.

3. A non-transitory computer-readable storage medium according to claim 1, wherein the brief window function is narrower than other window functions in the frame.

4. A non-transitory computer-readable storage medium according to claim 1, wherein all window functions in the frame overlap each other in a manner so as to satisfy perfect reconstruction conditions.

5. A non-transitory computer-readable storage medium according to claim 1, further comprising a step of repeating steps (a)-(d) a plurality of times for different frames of data.

6. A non-transitory computer-readable storage medium according to claim 1, wherein step (c) includes selecting window functions for all the blocks within the frame, said window functions including a standard transient-frame window function, wherein the brief window function is narrower than the standard transient-frame window function, and at least one of (i) a pre-transient transition window function and (ii) a post-transient transition window function.

7. A non-transitory computer-readable storage medium according to claim 6, wherein (i) the brief window function is used in the block that includes the transient;

(ii) the pre-transient transition window function is used in the block, if any, within the frame that immediately precedes the block that includes the transient; and (iii) the post-transient transition window function is used in the block, if any, within the frame that immediately follows the block that includes the transient.

8. A non-transitory computer-readable storage medium according to claim 1, wherein the substantially constant portion is exactly 96 samples long.

9. A non-transitory computer-readable storage medium according to claim 1, wherein the brief window function is nonzero within its central 160 samples only.

10. A system for processing frame-based data, comprising:

(a) means for obtaining a frame of audio data, an indication that a transient occurs within the frame, and a location of the transient within the frame;

(b) means for setting a block size of 256 samples for the frame based on the indication of the transient, thereby effectively defining a plurality of equal-sized blocks within the frame;

(c) means for selecting a brief window function for a block within the frame that includes the transient; and (d) means for processing the frame of audio data by applying the brief window function as selected by said means (c), wherein the brief window function includes a rising portion followed by a substantially constant portion followed by a falling portion, and wherein the rising portion and the falling portion of the brief window function are each 32 samples long.

11. A system according to claim 10, wherein the brief window function includes exactly 48 zero weights immediately before the rising portion, which are applied to the first samples of the transient block, and also includes 48 zero weights immediately after the falling portion, which are applied to the last samples of the transient block.

12. A system according to claim 10, wherein the brief window function is narrower than other window functions in the frame.

13. A system according to claim 10, wherein all window functions in the frame overlap each other in a manner so as to satisfy perfect reconstruction conditions.

14. A system according to claim 10, further comprising means for repeating instantiation of said means (a)-(d) a plurality of times for different frames of data.

15. A system according to claim 10, wherein said means (c) includes means for selecting window functions for all the blocks within the frame, said window functions including a standard transient-frame window function, wherein the brief window function is narrower than the standard transient-frame window function, and at least one of (i) a pre-transient transition window function and (ii) a post-transient transition window function.

16. A system according to claim 10, wherein the substantially constant portion is exactly 96 samples long.

17. A non-transitory computer-readable storage medium according to claim 1, wherein said steps (a)-(d) are performed as part of an audio encoder.

18. A non-transitory computer-readable storage medium according to claim 1, wherein said steps (a)-(d) are performed as part of an audio decoder.

19. A system according to claim 15, wherein (i) the brief window function is used in the block that includes the transient;

(ii) the pre-transient transition window function is used in the block, if any, within the frame that immediately precedes the block that includes the transient; and (iii) the post-transient transition window function is used in the block, if any, within the frame that immediately follows the block that includes the transient.

20. A system according to claim 10, wherein the brief window function is nonzero within its central 160 samples only.

21. A system according to claim 10, wherein said means (a)-(d) are part of an audio encoder.

22. A system according to claim 10, wherein said means (a)-(d) are part of an audio decoder.

* * * * *